US007057561B2

(12) United States Patent
Hsu

(10) Patent No.: US 7,057,561 B2
(45) Date of Patent: Jun. 6, 2006

(54) MULTI-FREQUENCY ANTENNA

(75) Inventor: Jui-Hung Hsu, Taipei (TW)

(73) Assignee: High Tech Computer Corp., Taoyuan (TW)

( * ) Notice: Subject to any disclaimer, the term of this patent is extended or adjusted under 35 U.S.C. 154(b) by 12 days.

(21) Appl. No.: 10/750,746

(22) Filed: Jan. 2, 2004

(65) Prior Publication Data

US 2005/0012668 A1 Jan. 20, 2005

(30) Foreign Application Priority Data

Jul. 15, 2003 (TW) ..... 92119341 A

(51) Int. Cl.
*H01Q 1/38* (2006.01)

(52) U.S. Cl. ..... 343/700 MS

(58) Field of Classification Search ..... 343/895, 343/700 MS, 702, 805, 809
See application file for complete search history.

(56) References Cited

U.S. PATENT DOCUMENTS

| | | | | |
|---|---|---|---|---|
| 6,008,762 | A * | 12/1999 | Nghiem | 343/700 MS |
| 6,064,351 | A * | 5/2000 | Mandai et al. | 343/873 |
| 6,166,694 | A | 12/2000 | Ying | 343/702 |
| 6,353,420 | B1 * | 3/2002 | Chung | 343/895 |
| 6,650,294 | B1 * | 11/2003 | Ying et al. | 343/700 MS |
| 6,727,854 | B1 * | 4/2004 | Fang et al. | 343/700 MS |
| 6,750,821 | B1 * | 6/2004 | Fang et al. | 343/700 MS |
| 6,842,158 | B1 * | 1/2005 | Jo et al. | 343/895 |
| 2002/0089454 | A1 | 7/2002 | Eggleston et al. | 343/702 |

FOREIGN PATENT DOCUMENTS

| | | | |
|---|---|---|---|
| EP | 1079462 | A2 | 2/2001 |
| EP | 1079462 | A3 | 5/2003 |
| WO | WO 01/200714 | A1 | 3/2001 |
| WO | WO 02/05382 | A1 | 1/2002 |

* cited by examiner

*Primary Examiner*—Hoang V. Nguyen
*Assistant Examiner*—Minh Dieu A
(74) *Attorney, Agent, or Firm*—Thomas. Kayden, Horstemeyer & Risley

(57) ABSTRACT

A multi-frequency antenna includes a antenna body, a patch antenna, and a ground plane. The antenna body has first and second radiation arms, a feed-in terminal, and a ground terminal disposed in one side of the antenna body for signal feeding, and grounding. The first and second radiation arms are arranged in a symmetrically inward spiral structure. Two current paths with different lengths are created, along with the two radiation arms from the feed-in terminal, and thereby the antenna is operable at two frequencies. An additional patch antenna can be disposed beside the antenna body to allow the antenna to have more operational frequencies. In practice, the length of the patch antenna can be designed according to the bandwidth of Bluetooth signals to meet the requirement of Bluetooth communication. The ground plane is disposed beneath the antenna body and the patch antenna for the purpose of grounding of the antenna's signals. In implementation, a section of the ground plane, which is above the endfire direction, can be hollowed to increase antenna's bandwidth. The hollowed section can also be used to dispose other components to increase the component density.

14 Claims, 4 Drawing Sheets

Channel Settings

| Channel | Sweep Type | Points | Start (MHz) | Stop (MHz) | IF BW (kHz) | Sweep Time (ms) | Pow 1 (dBm) | Pow 2 (dBm) |
|---|---|---|---|---|---|---|---|---|
| 1 | LinFreq | 201 | 800.000000 | 2000.000000 | 35.000 | 6.030 | 0.00 | 0.00 |

Trace Attributes

| Window | ID | Trace | Channel | Correction | Smooth | Options | Marker | Position | Response |
|---|---|---|---|---|---|---|---|---|---|
| 1 | 1 | S11 | 1 | C* 2-P SOLT | | | 1 | 824 MHz | 2.9281 |
| | | | | | | | 2 | 960 MHz | 2.8395 |
| | | | | | | | 3 | 1710 MHz | 1.7681 |
| | | | | | | | 4 | 1990 MHz | 2.9952 |
| | | | | | | | 5 | 1990 MHz | 2.9952 |

| Channel | Sweep Type | Points | Start (MHz) | Stop (MHz) | IF BW (kHz) | Sweep Time (ms) | Pow 1 (dBm) | Pow 2 (dBm) |
|---|---|---|---|---|---|---|---|---|
| 1 | LinFreq | 201 | 2000.000000 | 3000.000000 | 35.000 | 6.030 | 0.00 | 0.00 |
| 2 | LinFreq | 201 | 0.300000 | 6000.000000 | 35.000 | 6.030 | 0.00 | 0.00 |
| 3 | LinFreq | 201 | 0.300000 | 6000.000000 | 35.000 | 6.030 | 0.00 | 0.00 |

| Window | ID | Trace | Channel | Correction | Smooth | Options | Marker | Position | Response |
|---|---|---|---|---|---|---|---|---|---|
| 1 | 1 | S11 | 1 | C 1-Port | | | 1 | 2400 MHz | -10.540 dB |
| | | | | | | | 2 | 2450 MHz | -21.044 dB |
| | | | | | | | 3 | 2500 MHz | -12.485 dB |

MULTI-FREQUENCY ANTENNA

This application claims the benefit of Taiwan application Serial No. 092119341, filed on Jul. 15, 2003, the subject matter of which is incorporated herein by reference.

BACKGROUND OF THE INVENTION

1. Field of the Invention

The invention relates in general to a type of antenna, and more particularly to a type antenna that has multiple operational frequencies.

2. Description of the Related Art

The electronic industry is having its prosperity nowadays; different types of portable electronic devices are also very popular. Taking the personal digital assistant (PDA) as an example, in addition to the decreasing size of the products, the ability to do wireless transmission is also a research focus that engineers try their very best in order to obtain an competitive edge over their competitors.

In a wireless system, the antenna is the window for signal transmission and it directly influences the transmission quality of the wireless signals. Its significance is self-evident. Among the different structures of antenna, the microstrip antenna is a mature technology that (1) has simple structure, (2) has small size, and (3) can easily be integrated into circuit boards. Those properties allow microstrip antennas to play an important role in personal communicational systems. However, despite of its advantageous features, in order to realize its full potential, other objective conditions such as low dielectric constant, large current distribution, and low loss in the antenna's material need to be met. The overall quality of the antenna is closely related to these conditions.

In addition to low return loss, consideration for bandwidth is also an important factor for a good design of an antenna. In the past, designers usually increased the size of the antenna or decreased the dielectric constant of the substrate in order to achieve greater bandwidth. These old methods resulted in waste of available room in circuit boards and they are no longer viable choices due to the requirement for increasing components density in portable devices nowadays.

SUMMARY OF THE INVENTION

It is therefore an object of the invention to provide a multi-frequency antenna that has the ability to operate in multiple frequencies and has better performance by increasing the bandwidth through better utilization of the available room.

The invention achieves the above-identified object by providing a multi-frequency antenna. The multi-frequency antenna includes an antenna body, a patch antenna, and a ground plane. The antenna body has first and second radiation arms, as well as a feed-in terminal and a ground terminal both disposed in one side of the antenna body for the purpose of signal feeding and grounding. The first and second radiation arms are arranged in a symmetrically inward spiral structure. Two current paths with different lengths are created along the two radiation arms from the feed-in terminal, thereby enabling the antenna to operate at two frequencies. Furthermore, a patch antenna can be disposed beside the antenna body to allow the antenna to have more operational frequencies. In practice, the length of the patch antenna can be designed according to the bandwidth used by Bluetooth signals in order to meet the requirement of Bluetooth communication. The ground plane is located beneath the antenna body and the patch antenna for the purpose of grounding of the antenna's signals. In implementation, a section of the ground plane, which is above the endfire direction, can be hollowed in order to increase antenna's bandwidth. The hollowed section can also be used to dispose other components in order to increase the component density.

Other objects, features, and advantages of the invention will become apparent from the following detailed description of the preferred but non-limiting embodiments. The following description is made with reference to the accompanying drawings.

DETAILED DESCRIPTION OF THE INVENTION

Figure 1A:
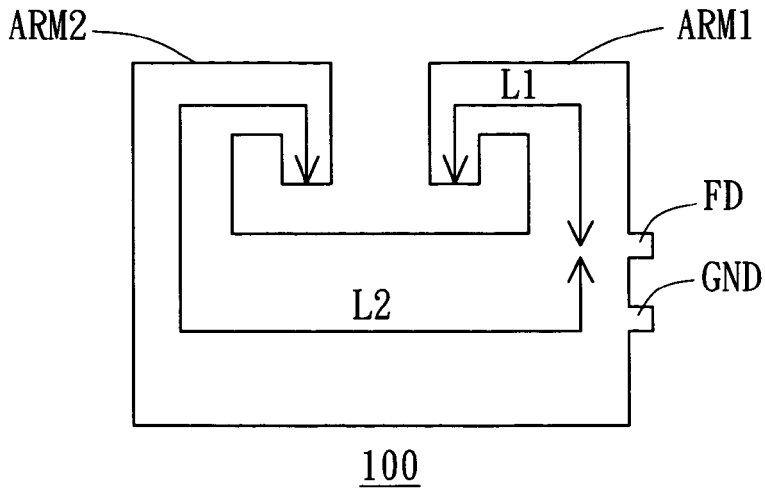
FIG. 1A is a diagram illustrating a multi-frequency antenna according to a preferred embodiment of the invention.

Referring to FIG. 1A, the antenna body 100 has a first radiation arm ARM1 and a second radiation arm ARM2. The antenna body 100 is also equipped with a feed-in terminal FD and a ground terminal GND for feed-in of signals and grounding of signals respectively. According to the structure of the antenna, two major current paths are formed; current path L1 starts from feed-in terminal FD and goes through the radiation arm ARM1; current path L2 starts from feed-in terminal FD and goes through the radiation arm ARM2. In particular, the current path L1 is shorter than the current path L2. When the signal is fed into the antenna body 100, the antenna has a higher operational frequency $f_H$ if resonance occurs across the current path L1. If resonance occurs across the current path L2, the antenna has a lower operational frequency $f_L$. Thus, the antenna body 100 is operable at two frequencies. By adequate adjustment of the current paths, the operational frequency $f_L$ can be set within the GSM bandwidth (824~960 MHz), and the operational frequency $f_H$ can be set within the PCS bandwidth (1710~1900 MHz). Therefore, the requirement for the dual-frequency operation modes with central frequencies of 900 MHz and 1800 MHz, for example, can be achieved.

Figure 1B:
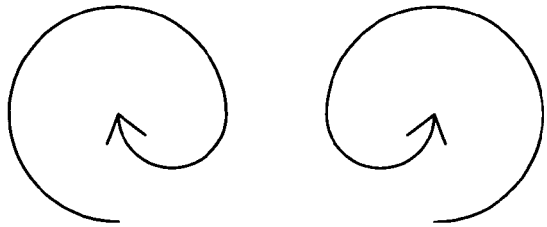
FIG. 1B illustrates a symmetrically inward spiral structure.

In order to decrease the size of the antenna, the radiation arms ARM1 and ARM2 of the antenna body 100 is designed in the form of a symmetrically inward spiral structure, as depicted in FIG. 1B. Symmetrically inward spiral structure means that the current paths created by the two radiation arms both spiral inwardly; the radiation arm ARM1 extends dextrorotarily, and the radiation arm ARM2 extends levorotarily. Because both extensions of the radiation arms go inwardly, the lengths of the current paths can be increased in the limited space and therefore the size of the antenna can be effectively reduced.

Figure 2:
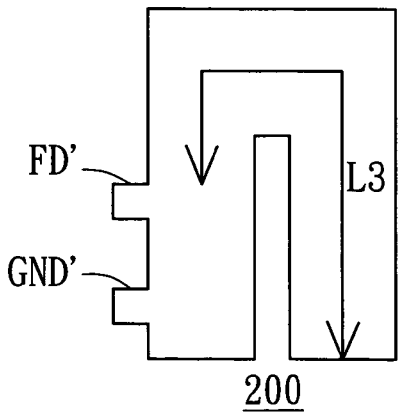
FIG. 2 illustrates a patch antenna.

Additionally, in order to allow the antenna to have more operational frequencies, a patch antenna can be disposed next to the antenna body to obtain more flexibility for the application of the antenna. Referring to FIG. 2, a patch antenna 200 has a feed-in terminal FD', and a ground terminal GND'. The current path L3 created from the feed-in terminal FD' allows the patch antenna 200 to have a third operational frequency f that is different to both the operational frequencies $f_H$ and $f_L$. In practice, the length of the current path L3 can be designed for the bandwidth of blue tooth signal by setting f to 2.45 GHz in order to meet the requirement for Bluetooth communication.

Figure 3B:
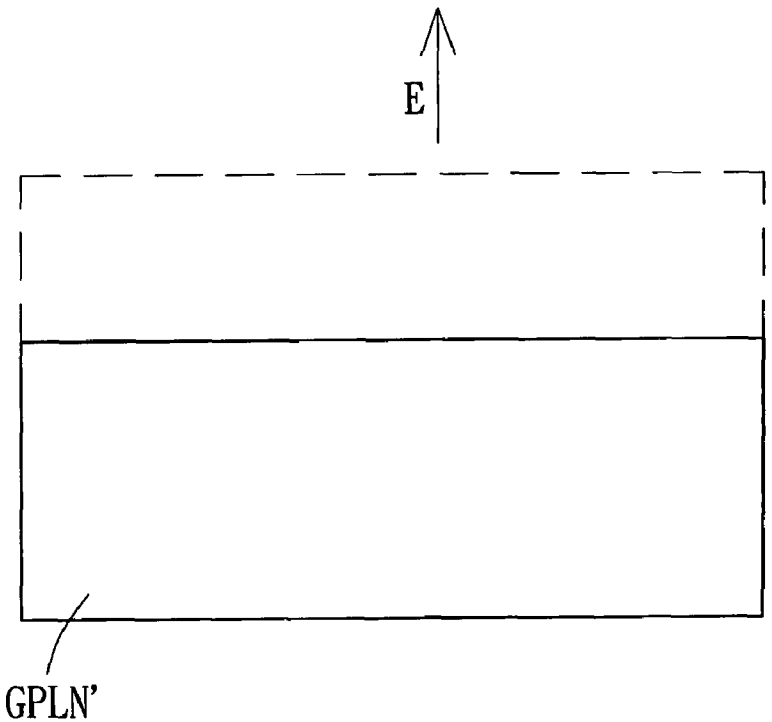
FIG. 3B shows that the ground plane is partially hollowed.
Figure 3A:
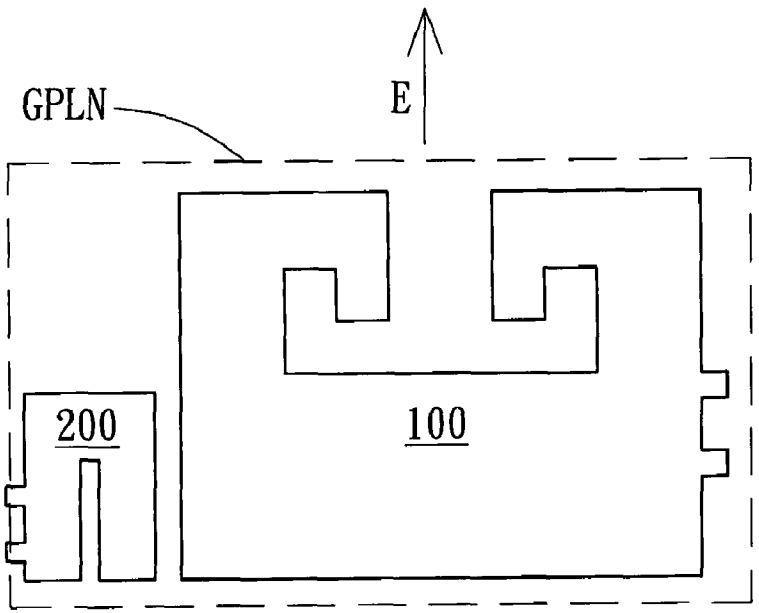
FIG. 3A depicts the arrangement of the antenna body, the patch antenna, and the ground plane of the multi-frequency antenna.

FIG. 3A depicts the arrangement of the antenna body 100, the patch antenna 200, and ground plane GPLN of the multi-frequency antenna. As shown in FIG. 3A, the antenna body 100 and the patch antenna 200 are disposed nearly. For example, the antenna body 100 and the patch antenna 200 are disposed at a distance of about 1 to 7 mm in order to be coupled to PCS bandwidth. Further, the ground plane GPLN, indicated by the dashed line, is electrically coupled to the ground terminals GND and GND', is beneath the antenna body 100 and the patch antenna 200. When the antenna is working, the electric field radiates from the antenna in the endfire direction E. In order to increase the bandwidth of the antenna, a section of the ground plane GPLN can be hollowed, or cut off, as depicted in FIG. 3B, for example. After hollowing the part of the ground plane GPLN with respect to the endfire direction, as shown in FIG. 3B, (the hollowed section is shown as the area enclosed by the dashed line), the area of the actual ground plane GPLN' is less than that of the original ground plane GPLN, whereby the antenna bandwidth can be increased. Moreover, the space saved by the hollowed section can be used to dispose other components, such as slots for interface cards, to better utilize the available room in a circuit board and increase the component density.

Figure 4:
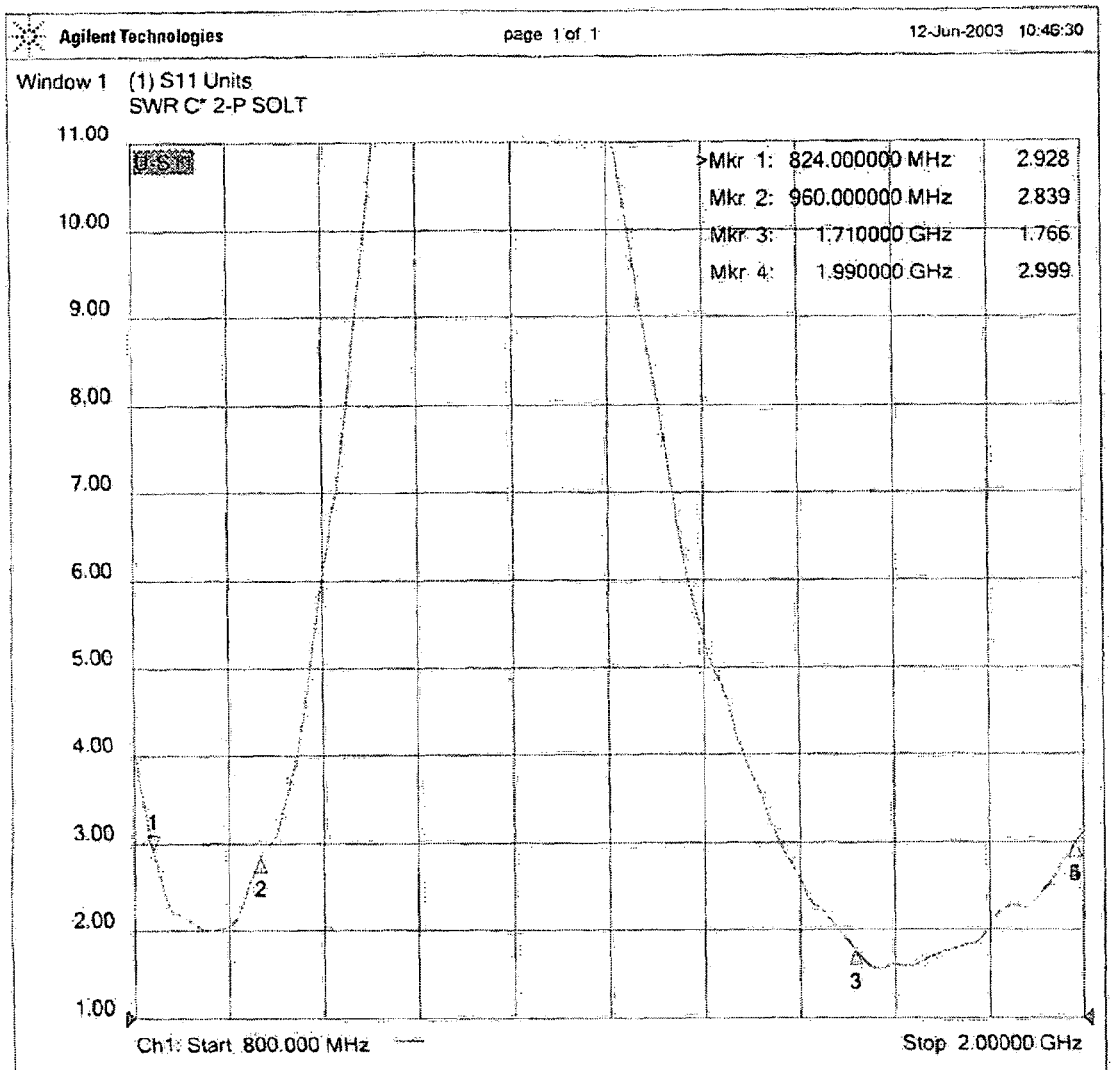
FIG. 4 charts the measurement result of the return loss of the antenna body 100.
Figure 5:
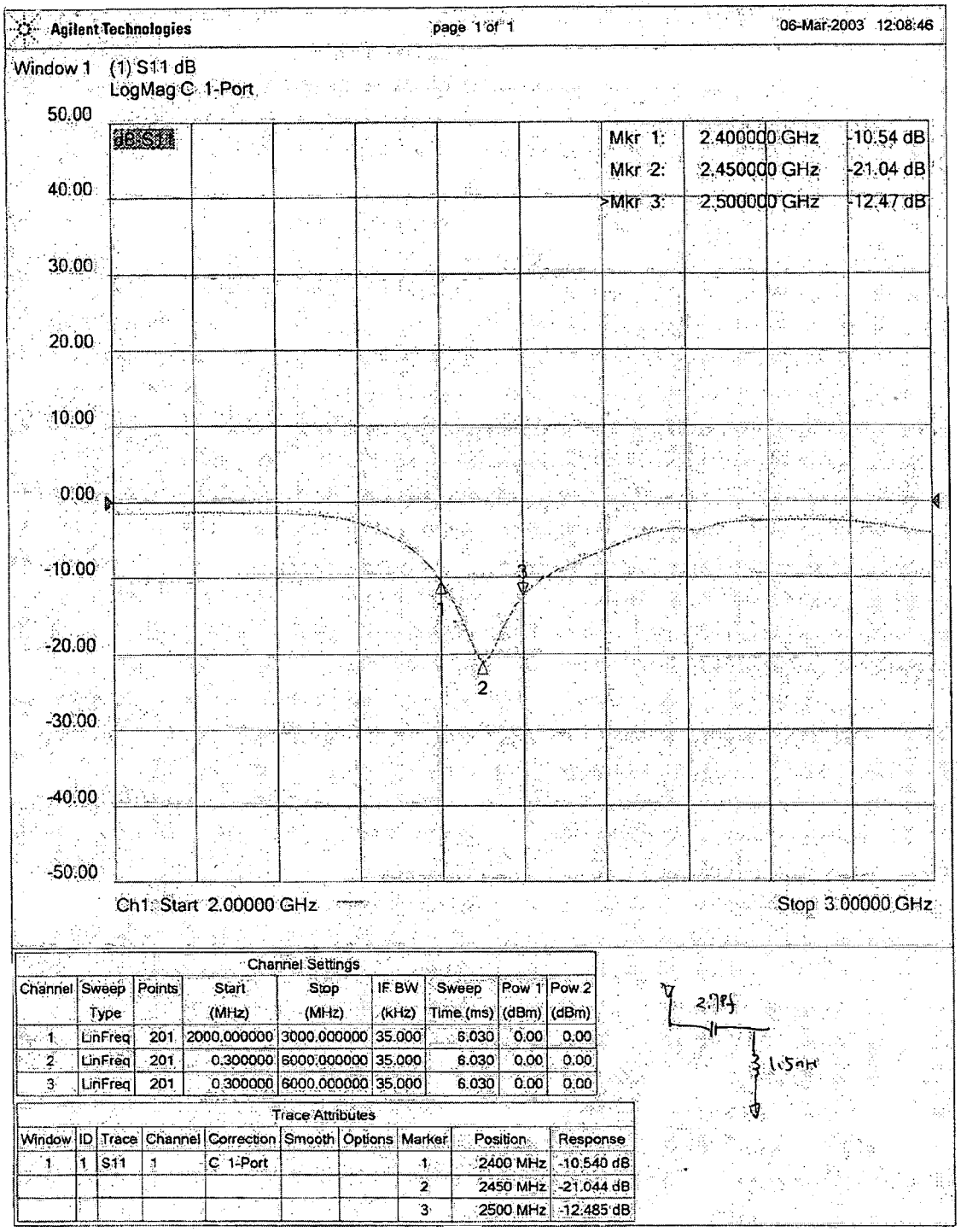
FIG. 5 charts the measurement result of the return loss of the patch antenna 200.

FIG. 4 charts the measurement result of the return loss of the antenna body 100. If the operational bandwidth is defined by the voltage standing wave ratio (VSWR) having a value less than 3, the antenna body 100 certainly satisfies the design requirements of both GSM bandwidth and DCS bandwidth, especially for high frequency. FIG. 5 charts the measurement result of the return loss of the patch antenna 200. If the operational bandwidth is defined by S11 having a value less than −10 dB, the characteristics of the patch antenna 200 meet the requirement for Bluetooth signaling according to the frequency range set in the Bluetooth standard.

The multi-frequency antenna proposed by the invention has at least the following advantages.

The symmetrically inward spiral structure adopted in the antenna body effectively reduces the size of the antenna.

The design of hollowing the section of the ground plane increases the bandwidth of the antenna and the hollowed section can be used to provide space for other components in order to increase the component density.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A multi-frequency antenna with a first operational frequency and a second operational frequency for a portable electronic device, the multi-frequency antenna comprising:

an antenna body including a feed in terminal, a ground terminal, a first radiation arm, and a second radiation arm, wherein the first and second radiation arms are arranged in symmetrically inward spiral form, share the feed-in terminal, and form a first current path and a second current path which realize the first and second operational frequencies respectively; and a ground plane, coupled to the ground terminal and disposed with respect to the antenna body.

2. The multi-frequency antenna according to claim 1, wherein the ground plane has a hollowed section which is beneath the endfire direction of the antenna.

3. The multi-frequency antenna according to claim 2, wherein the first operational frequency belongs to GSM bandwidth, and the second operational frequency belongs to DCS bandwidth.

4. The multi-frequency antenna according to claim 1, wherein the first operational frequency belongs to GSM bandwidth, and the second-operational frequency belongs to DCS bandwidth.

5. A portable electronic device with a first operational frequency, a second operational frequency, and a third operational frequency, the portable electronic device comprising:

a multi-frequency antenna, comprising:

an antenna body including a feed-in terminal, a ground terminal, a first radiation arm, and a second radiation arm, wherein the first and second radiation arms are arranged in symmetrically inward spiral form, share the feed-in terminal, and form a first current path and a second current path which realize the first and second operational frequencies respectively; and a ground plane, coupled to the ground terminal and disposed with respect to the antenna body; and a patch antenna, separately disposed in a side of the multi-frequency antenna, having a third current path to realize the third operational frequency.

6. The portable electronic device according to claim 5, wherein the ground plane has a hollowed section which is beneath the endfire direction of the antenna.

7. The portable electronic device according to claim 6, the first operational frequency belongs to GSM bandwidth, the second operational frequency belongs to DCS bandwidth, and the third operational frequency is 2.45 GHz.

8. The portable electronic device according to claim 5, wherein the antenna body and the patch antenna are disposed at a distance of about 1 to 7 mm in order to be coupled to PCS bandwidth.

9. The portable electronic device according to claim 8, wherein the first current path has a length which sets the first operational frequency within GSM bandwidth, the second current path has a length which sets the second operational frequency within PCS bandwidth.

10. The portable electronic device according to claim 5, wherein the first current path sets the first operational frequency within GSM bandwidth, and the second current path sets the second operational frequency within DCS bandwidth.

11. A portable electronic device with a first operational frequency, a second operational frequency, and a third operational frequency, the portable electronic device comprising:

a multi-frequency antenna, comprising:

an antenna body including a feed-in terminal, a ground terminal, a first radiation arm, and a second radiation arm, wherein the first and second radiation arms are arranged in symmetrically inward spiral form, share the feed-in terminal, and form a first current path and a second current path which realize the first and second operational frequencies respectively; and a ground plane, coupled to the ground terminal and disposed with respect to the antenna body; and a patch antenna, separately disposed in a side of the multi-frequency antenna, having a third current path to realize the third operational frequency, wherein the third current path sets the third operational frequency meeting the requirement of Bluetooth communication.

12. The portable electronic device according to claim 11, wherein the antenna body and the patch antenna are disposed at a distance of about 1 to 7 mm in order to be coupled to PCS bandwidth.

13. The portable electronic device according to claim 11, wherein the first operational frequency belongs to GSM bandwidth, the second operational frequency belongs to DCS bandwidth, and the third operational frequency is 2.45 GHz.

14. A multi-frequency antenna with a first operational frequency and a second operational frequency, the multi-frequency antenna comprising:

an antenna body including:

a ground terminal;

a first radiation arm and a second radiation arm, wherein the first and second radiation arms are arranged symmetrically, each wind inward and around respective central points, share the feed-in terminal, and have an first open end and a second open end respectively; and a feed-in terminal, located on one side of the first and second arms so that a first current path and a second current path, different in length, are respectively created along the first and second radiation arms from the feed-in terminal to the first and second open ends, and realize the first and second operational frequencies, respectively; and a ground plane, coupled to the ground terminal and disposed with respect to the antenna body.

* * * * *